United States Patent [19]

Zelkowitz

[11] Patent Number: 4,540,966

[45] Date of Patent: Sep. 10, 1985

[54] MULTIPLE MAGNET CORE UNIT

[75] Inventor: Phillip Zelkowitz, Lincolnwood, Ill.

[73] Assignee: Albany-Chicago Corporation, Chicago, Ill.

[21] Appl. No.: 444,346

[22] Filed: Nov. 24, 1982

[51] Int. Cl.[3] ..... H01F 3/00

[52] U.S. Cl. ..... 335/297; 335/281

[58] Field of Search ..... 335/285, 286, 287, 288, 335/289, 291, 296, 297, 281

[56] References Cited

U.S. PATENT DOCUMENTS

| | | | |
|---|---|---|---|
| 930,659 | 8/1909 | Geer . | |
| 1,009,426 | 11/1911 | Lorimer . | |
| 2,179,625 | 11/1939 | Groden | 335/295 |
| 2,306,732 | 12/1942 | Huxham . | |
| 2,360,928 | 10/1944 | Beechlyn | 335/288 |
| 2,915,812 | 12/1959 | Rettinger . | |
| 3,042,999 | 7/1962 | Page et al. . | |
| 3,064,333 | 11/1962 | Kristiansen et al. . | |
| 3,120,696 | 2/1964 | Lubkin . | |
| 3,217,389 | 11/1965 | Neumann et al. . | |
| 3,242,556 | 3/1966 | Broughton . | |
| 3,633,274 | 1/1972 | Miyata . | |
| 3,659,821 | 5/1972 | Sakamoto et al. . | |
| 3,670,112 | 6/1972 | Ruszczyk et al. . | |
| 3,712,565 | 1/1973 | Bement et al. . | |
| 3,737,992 | 6/1973 | Braun et al. . | |
| 3,833,869 | 9/1974 | Cassarly et al. . | |
| 3,909,932 | 10/1975 | Kroon . | |
| 4,076,791 | 2/1978 | Barter et al. . | |
| 4,332,537 | 6/1982 | Slepcevic . | |

FOREIGN PATENT DOCUMENTS 2211176 9/1972 Fed. Rep. of Germany .

*Primary Examiner*—George Harris

*Attorney, Agent, or Firm*—Hill, Van Santen, Steadman & Simpson

[57] ABSTRACT

A multiple magnet core unit for relays of teleprinters and the like has a non-magnetic cast metal frame providing an elongated platform for one or more rows of upstanding magnetic metal core fingers which are transversely spaced along the length of the platform and have integral depending anchoring tabs cast in situ in the non-magnetic metal. The fingers are U-shaped with each upstanding leg having the metal grain extending lengthwise thereof and adapted to receive a coil therearound to provide an electromagnet and with the tab depending from the bight portion of the U integrally anchored to and surrounded by the cast metal. To produce the unit, the core fingers are mounted in transverse slots of an elongated holder with the tabs on the fingers projecting beyond the holder. A pair of holders are mounted in a die casting machine to span the molding cavity and the casting is formed around the tabs. Supporting pins prevent the weight of the holders from warping the casting as it is ejected from the mold cavity. The holders are then stripped from the casting and the casting is clamped as it cools to prevent sagging or warping after the stripping operation.

11 Claims, 16 Drawing Figures

FIG. 1
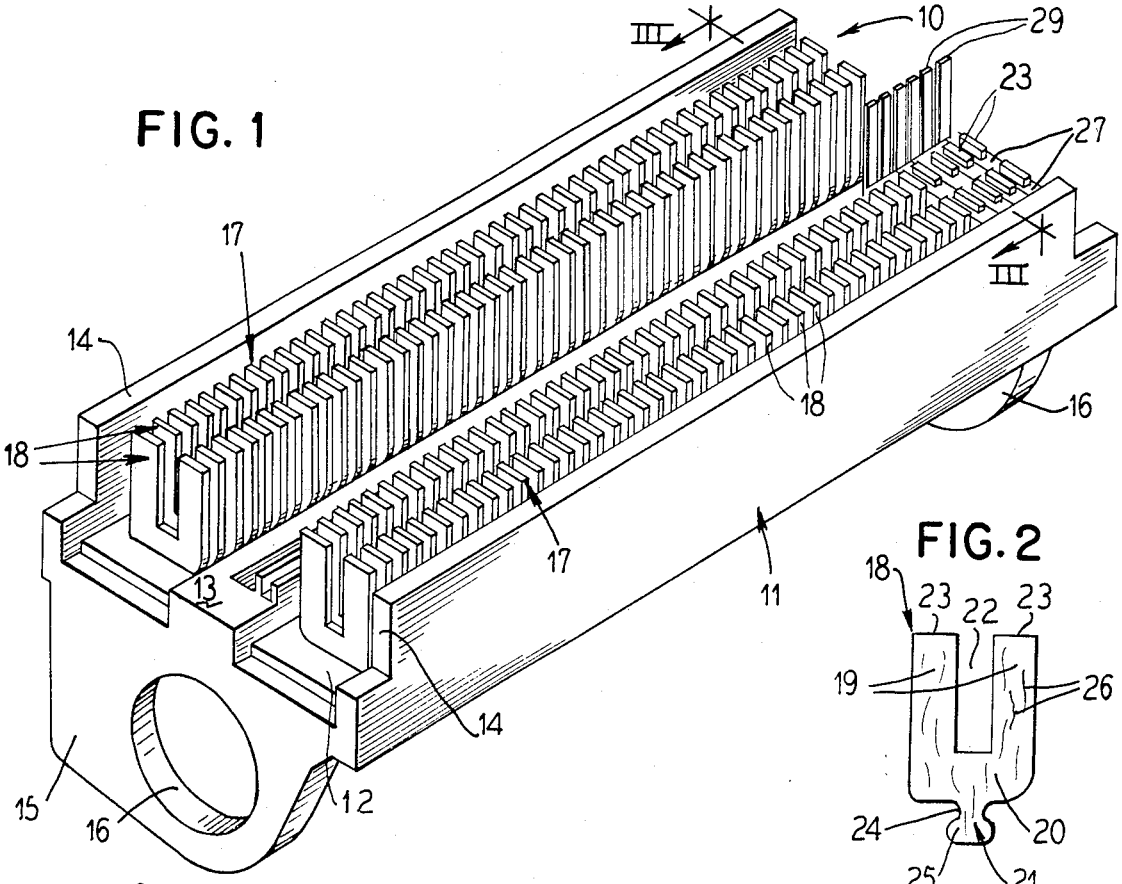
FIG. 2
FIG. 4
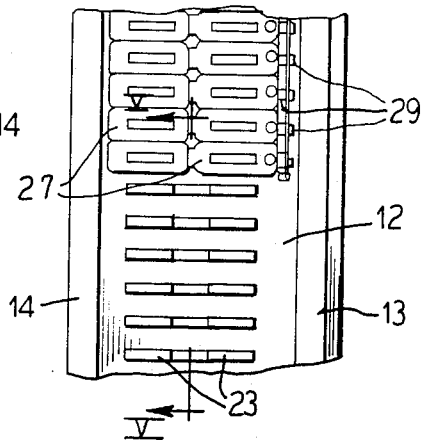
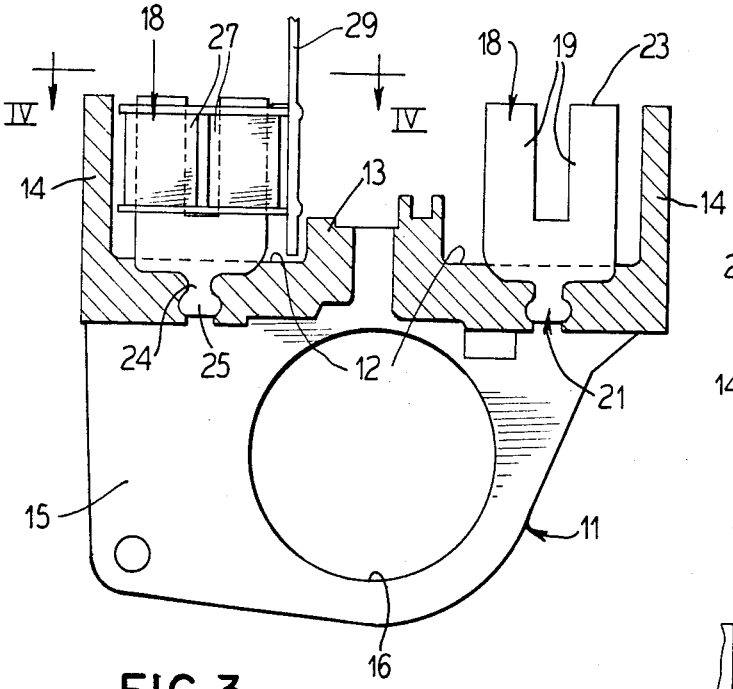
FIG. 3
FIG. 5
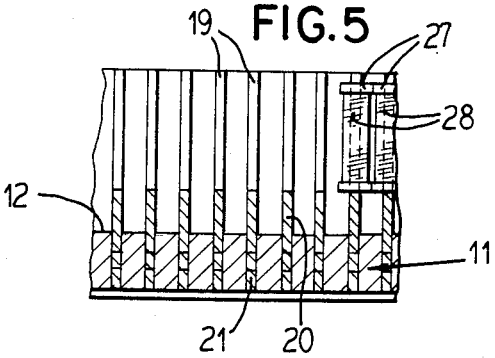

FIG. 7
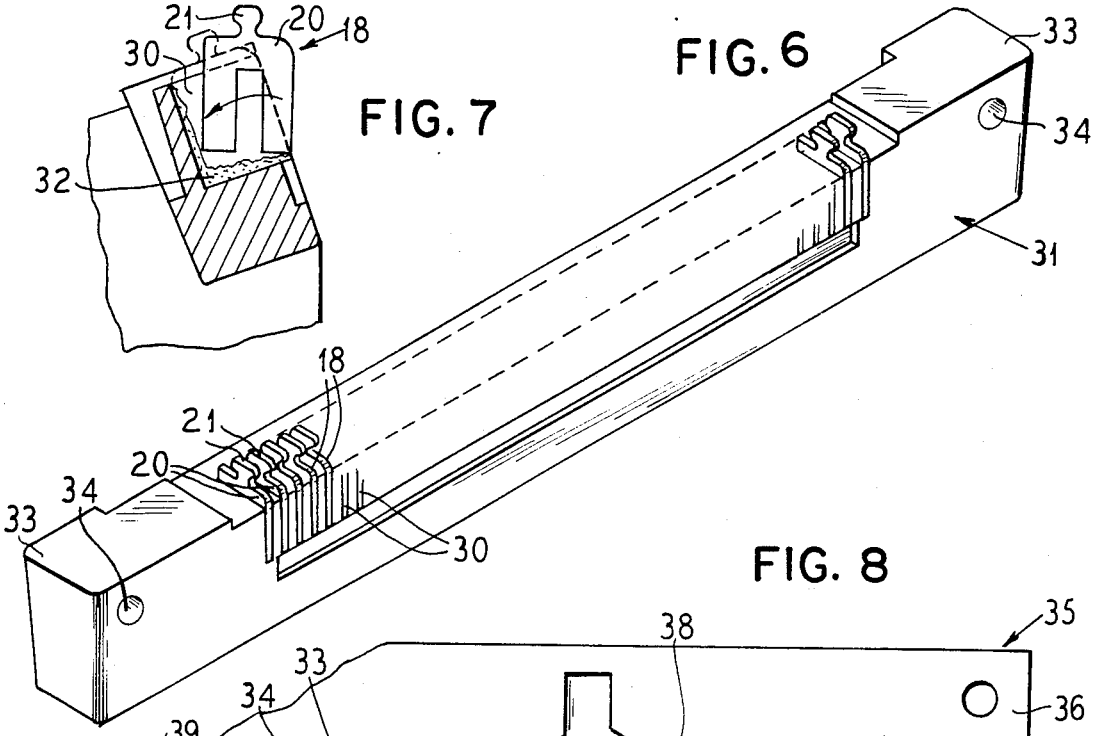
FIG. 6
FIG. 8
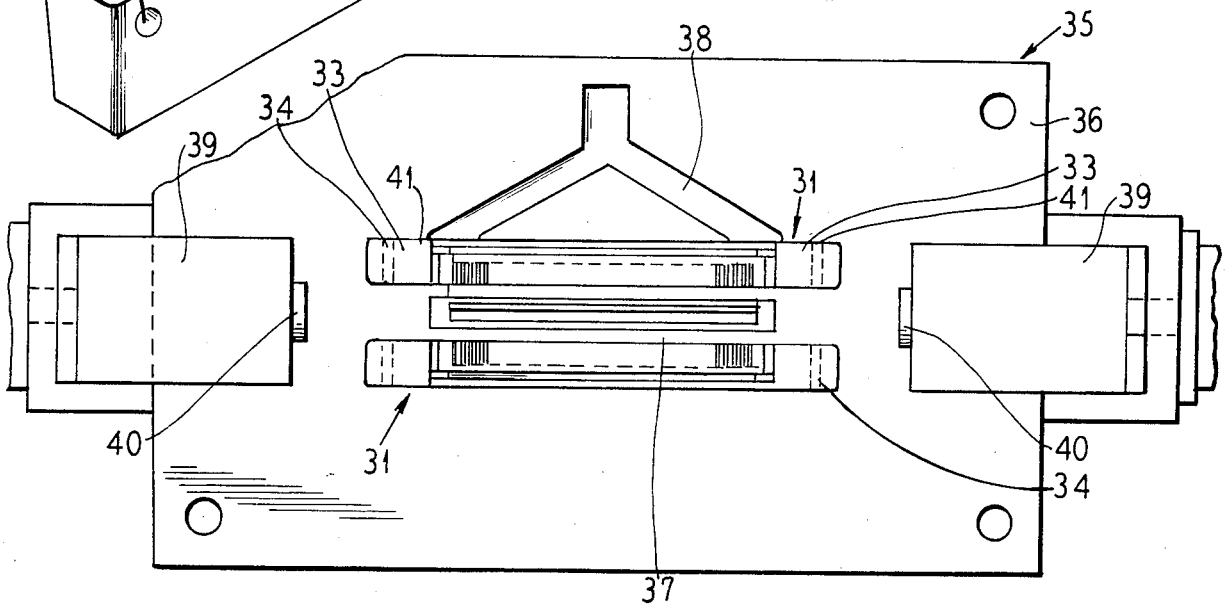
FIG. 9
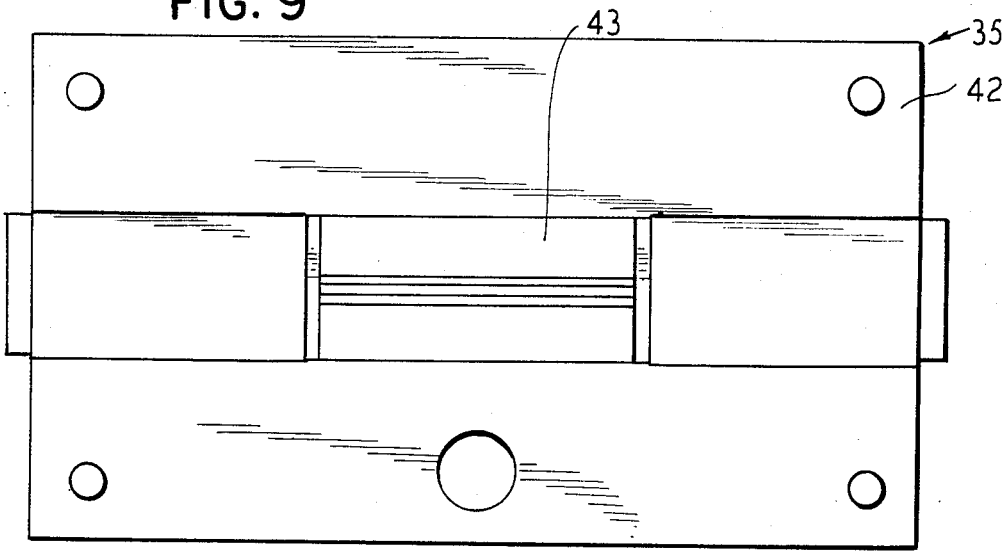

MULTIPLE MAGNET CORE UNIT

BACKGROUND OF THE INVENTION

1. Field of the Invention

This invention relates to the art of precisely positioning and anchoring inserts in die castings and specifically deals with the production of aluminum frames supporting in fixed integral relation a plurality of upstanding steel fingers in precise position to receive coils therearound to provide relays for teleprinters and the like apparatus where electrical input produces mechanical movement.

2. The Prior Art

The production of frames carrying magnetic coils for relays and the like has heretofore required drilling of the frame, anchoring portions of the core fingers into the drilled holes and cementing the fingers in position. Since the fingers must be precisely positioned on the frame, the drilling, pressing, and cementing operations required the skilled services of experienced technicians, were expensive and time-consuming and required an epoxy type cement which could deteriorate and lessen the reliability of the product.

It would therefore be an improvement in the art if the heretofore mechanical operations and the use of cement could be eliminated.

SUMMARY OF THIS INVENTION

According to this invention, inserts are precisely positioned and anchored to frames or bases in a die casting process where the cast metal is formed in-situ around portions of the inserts as they are held in the molding cavity die. Specifically, a plurality of inserts are mounted in one or more holders in the exact precise positions they are to occupy in the finished product. Anchoring portions of the inserts project from the holders. The holders are mounted in pockets of a die of a casting machine to span the molding cavity and present the projections of the inserts to the interior of the cavity. The dies of the machine are closed and the frame or base metal is then cast around the projecting portions of these inserts and is shaped by the die cavity to form the desired frame or base unit.

When the casting machine is opened, the casting in the holders is partially ejected from the molding cavity but those portions of the holders which were seated in the pockets of the die project from the casting and the holders are immediately supported at these projecting end portions to prevent the weight of the holders from sagging the soft hot casting. The supported holders and casting are then completely stripped from the die. The casting and holders are removed from the machine and the casting is then stripped from the holders with those portions of the inserts that were seated in the holders forming upstanding precisely positioned fingers or the like.

The cast frame or base has an elongated platform from which project one or more rows of stamped metal U-shaped core finger plates extending transversely along the length of the platform in equally spaced parallel relation. The legs of the U-shaped plates are adapted to receive spools of wound coils so that each leg becomes the core of an electromagnet with the free end edge of the leg acting on a relay finger so that when the coils are energized the finger will be magnetically pulled to the core. The bight portions of the U-shaped plates are bottomed on the platform but the central portion of the bight has a depending ear or tab submerged in and surrounded by the cast metal. This tab has a narrow shank portion merged into a larger head portion to increase the anchoring capacity.

In a preferred embodiment, the platform has two side-by-side rows of U-shaped core plates with each row containing about 40 or more finger plates and with each finger plate providing a pair of upstanding cores each receiving the thimble of wound core wire therearound.

The rows of fingers can be about 8 inches long with each finger plate being spaced apart about $\frac{1}{8}$ of an inch and having a thickness of about 1/16 of an inch. The finger plates project about one inch above the platform, the bight portion projects above the platform about $\frac{1}{4}$ inch, and the legs of each plate are about $\frac{1}{4}$ inch wide and transversely spaced about $\frac{3}{8}$ of an inch.

It is then an object of this invention to provide a unitary frame with a plurality of projecting precisely spaced fingers anchored in-situ in the frame and adapted to form the cores of electromagnets.

Another object of the invention is to provide a multiple magnet core unit for relays having a non-magnetic cast metal frame with an elongated platform from which project one or more rows of metal core fingers spaced transversely along the length of the platform and having portions embedded in and cast in-situ in the non-magnetic metal.

Another object of this invention is to provide a multiple magnet core unit for relays of teleprinters and the like having an aluminum frame defining an elongated platform from which project a pair of parallel rows of upstanding steel core fingers which are transversely spaced along the length of the platform and have integral depending anchoring tabs cast in-situ in the aluminum.

Other and further objects of this invention will become apparent to those skilled in this art from the following detailed description of the annexed sheets of drawings, which, by way of a preferred example illustrate a best mode embodiment of this invention.

ON THE DRAWINGS

FIG. 1 is a perspective view of a multiple magnet core unit of this invention.

FIG. 2 is a side elevational view of a core finger showing the metal grain of the fingers.

FIG. 3 is a transverse cross-sectional view along the line III—III of FIG. 1.

FIG. 4 is a plan view along the line IV—IV of FIG. 3.

FIG. 5 is a cross-sectional view along the line V—V of FIG. 4.

FIG. 6 is a perspective view of a holder for the core fingers.

FIG. 7 is a transverse cross-sectional view of the holder positioned in an angled support rack for ease in inserting the fingers.

FIG. 8 is a face view of the back plate of a casting machine with a die cavity for casting the units of this invention and showing a pair of holders mounted in pockets of the plate and spanning the die cavity.

FIG. 9 is a face view of the front plate of the casting machine illustrating the opposite portion of the mold cavity.

AS SHOWN ON THE DRAWINGS

Figure 10:
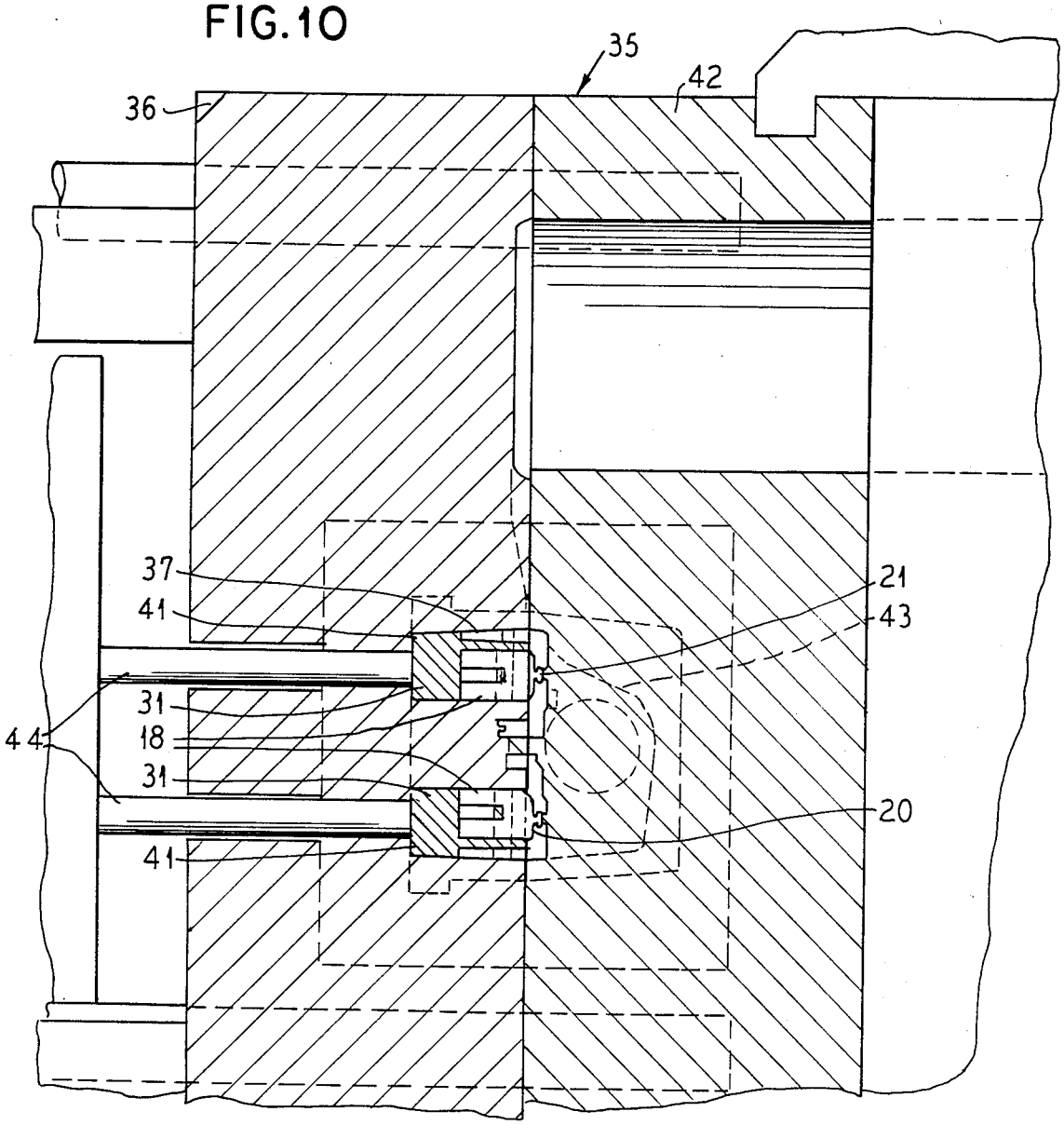
FIG. 10 is a transverse cross-sectional view through the die casting machine illustrating the molding dies in closed position.

In FIG. 1 the reference numeral 10 designates generally a multiple magnet core unit for a teleprinter relay according to this invention. The unit 10 has a die cast aluminum frame or base 11 with a flat top platform 12 extending lengthwise thereof with a central ridge 13 dividing the platform 12 into side-by-side strips bounded on their adjacent sides by the ridge and on their outer sides by upstanding flanges 14.

The ends of the casting 11 have depending ears or bosses 15 with large circular holes 16 therethrough.

The portions of the platform 12 on each side of the central ridge 13 each have a row 17 of U-shaped steel core plates 18 extending transversely thereacross in equally spaced relation along the length of the platform. Each finger plate 18 as shown in FIG. 2 has a pair of upstanding legs 19 connected at their bottom ends by a bight portion 20 from which depends a central tab or ear 21. The fingers are separated by a central upstanding slot 22 bottomed at the top end of the bight portion 20. Each finger has a flat top edge 23 on opposite sides of the slot positioned flush with the tops of the flanges 14. The tab 21 has a narrow shank portion 24 depending from the bottom of the bight 20 to an enlarged rounded head 25.

The finger plate 18 is preferably stamped from a high magnetic metal strip such as No. 5 Norway Steel with the metal grain extending lengthwise as illustrated at 26. The cast metal base or frame 11 is preferably A.S.T.M. aluminum No. 380. The base or frame metal, however, can be any die casting material of a non-magnetic nature including magnesium, zinc, white metal alloy and the like.

As illustrated at 27 in FIGS. 1, 3, 4 and 5 each leg 19 of each plate 18 receives a plastic spool 27 therearound. Each spool has a winding of wire 28 therearound the ends of which are connected to upstanding contact fingers 29 which also provide lateral supports for the plastic spool. When current flows through the coils 28, relay fingers (not shown) are depressed to the ends 23 of the legs 19. Electromagnets energizing the relay fingers are thus provided.

As shown in FIG. 3, the shank 24 and head 25 of the ears or tabs 21 are embedded in the metal of the platform 12 and are fixedly anchored in the cast metal so that the plates 18 cannot shift relative to the platform. It is important that the ends 23 of the legs 19 be at a uniform height and remain accurately positioned after long and repeated usage. The tabs 21 are effective to accomplish a fixed lock between the plate metal and the cast metal. Orientation of the grain 26 of the plate metal enhances the paramagnetic strength of the cores for the electromagnets that are thus provided.

FIGS. 7 through 16 illustrate a best mode method for producing the units 11 of this invention.

As shown in FIGS. 7 and 8, the U-shaped plates 18 are snugly seated in open top and open front slots 30 of a metal holder 31 and as illustrated in FIG. 7, each plate 18 is rocked into its slot 30 against a small amount of inserted putty 32 which seals against ingress of any metal in a subsequent die casting operation. The plates 18 have their bight portions 20 projecting slightly beyond the tops of the slots with the tabs 21 projecting above the exposed bight portions. It is important that the projecting heights of the tabs 21 be uniform and the finger plates are tapped into the bottoms of the slots until all of the tabs are of uniform height. This operation squeezes putty from the slots and ensures sealing of the plates in the slots.

The holder 31 has projecting end portions 33 each with a hole 34 therethrough.

As illustrated in FIG. 8, a die casting machine 35 has a back plate 36 defining a mold cavity 37, a gate passage 38, and mountings for cores 39 with protrubances 40 to form the holes 16 in the ears 15 of the base frame 11. The mold cavity has pockets 41 receiving the ends 33 of the holders 31. A pair of holders are mounted in the die cavity and spaced in superimposed relation with the holes 34 thereon in alignment and the holes in the lower holder 34 are larger than the holes in the upper holder for a purpose hereinafter described.

The casting machine has a movable front plate 42 shown in FIG. 9 with a molding cavity 43 complementing the cavity 37.

As illustrated in FIG. 10, when the die plates 36 and 42 are closed, the holders 31 project the tabs 21 and exposed bight portions 20 into the mold cavity portion 43 of the die 42 and pockets 41 of the cavity 37 will snugly secure the holders 31 in position. Then when metal is injected, the casting base frame 11 is cast around the tabs and bight portions but the metal cannot enter the slots of the holders and the fingers of the plate 18 are not contacted by the metal. The casting machine has ejector pins 44 adapted to engage the holders 31.

Figure 11:
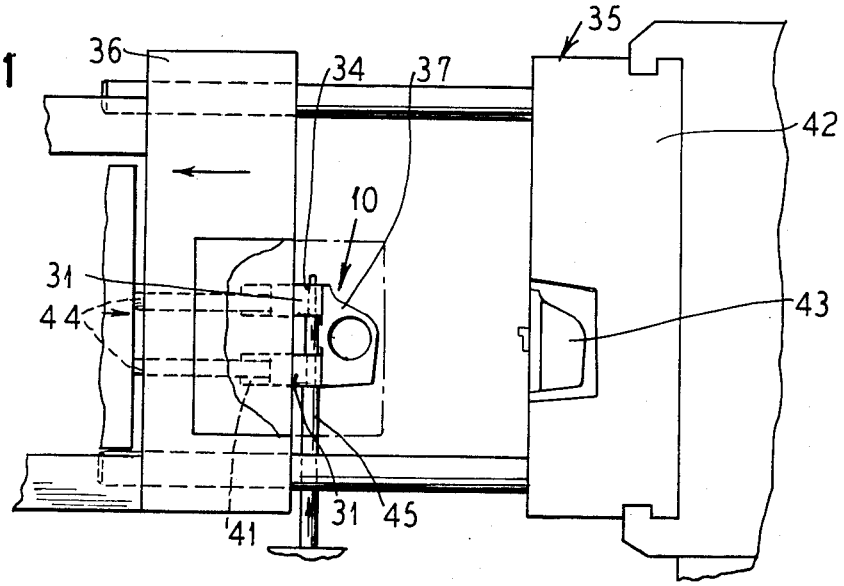
FIG. 11 is a view similar to FIG. 10 but illustrating the mold in opened position with the casting partially ejected from the mold cavity and the insert holders supported to prevent sagging of the casting.

As shown in FIG. 11, when the die plate 36 of the casting machine 35 is retracted from the die plate 42 after the die cavities have been filled with metal and the metal has at least partially solidified, the ejector pins 44 are activated to push the holders 31 out of their pockets 41 forcing the casting to partially protrude from the face of the die 36. Upright pins 45 are then activated to enter the holes 34 of the holder. The pins 45 have stepped portions providing shoulders on which the holders can rest and the different size holes in the bottom and top holders permit the pins to pass through the larger bottom hole so that their top shoulders can support the top holders.

Figure 12:
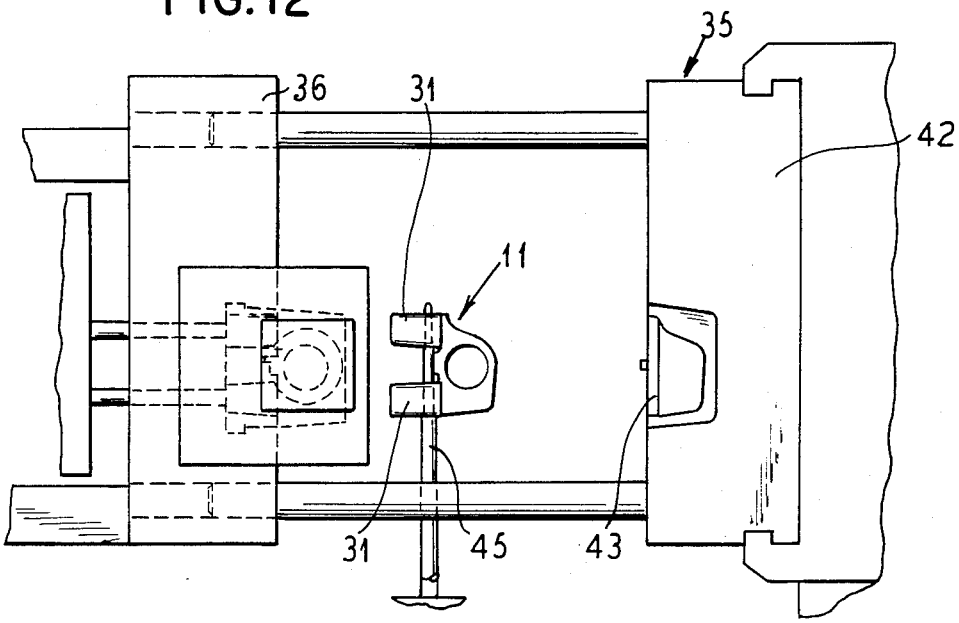
FIG. 12 is a view similar to FIG. 11 but showing the casting machine in fully opened position.

Then, as illustrated in FIG. 12, when the casting machine 35 is fully opened, the frame 11 still carrying the holders 31 is supported on the pins 45. The pins 45 thus prevent the weight of the holders 31 from sagging the freshly formed and still somewhat soft or deformable casting 11.

Figure 13:
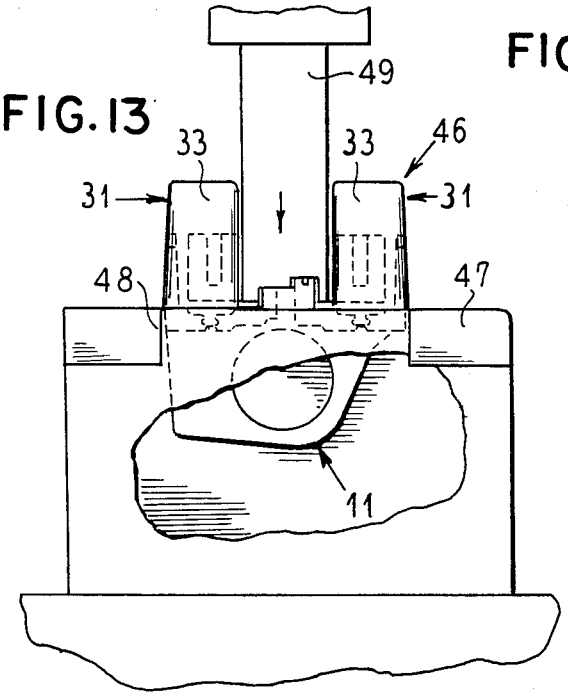
FIG. 13 is an end view of a press for stripping the casting from the holders.
Figure 14:
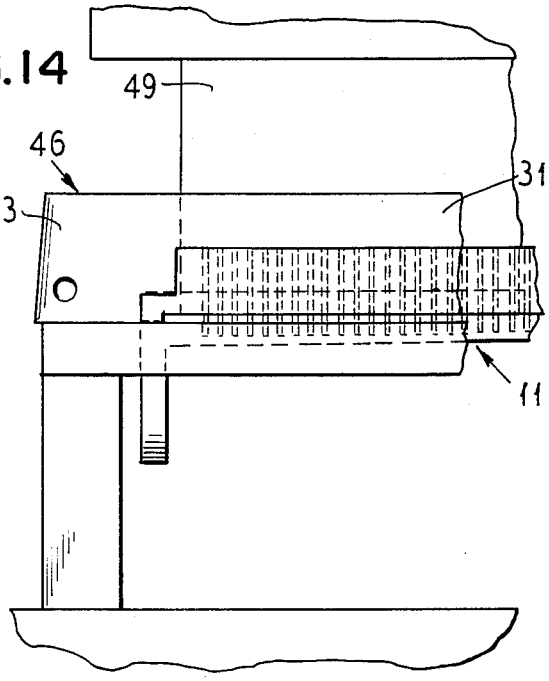
FIG. 14 is a fragmentary front view of the press of FIG. 13.

Next the casting 11 with the attached holders 31 is lifted off of the pins 45 and deposited in a press 46 shown in FIGS. 13 and 14. This press 46 has a table 47 with an opening 48 therethrough sized to accommodate the frame 11 while the ends 33 of the holders 31 rest on the table. The gate formed by the passageway 38 can then be broken off of the casting, a press head or plunger 49 lowered to engage the central portion of the casting between the holders 31 and the casting with the integrally attached fingers 18 is pushed out of the holders.

Figure 15:
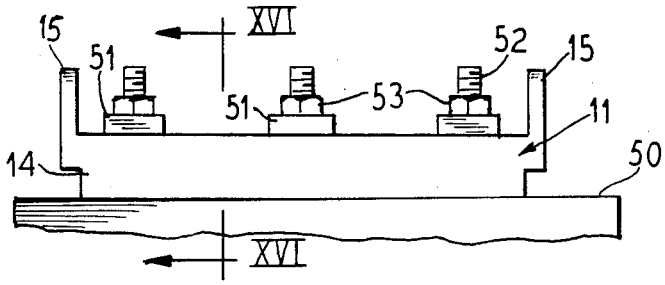
FIG. 15 is a front end view of a clamp press to hold the casting on a flat surface as it is being cooled.
Figure 16:
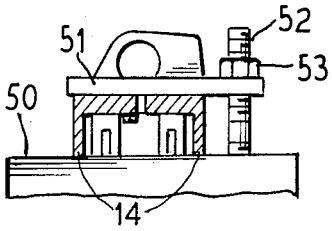
FIG. 16 is a transverse sectional view along the line XVI—XVI of FIG. 15.

Next the casting 11 with the attached fingers 18 while still hot is placed on a flat plate 50 illustrated in FIGS. 15 and 16 with the flanges 14 resting on the plate. Fingers 51 carried on upright studs 52 projecting from the plate 50 are then swung into position over the casting between the upstanding end ears 15 and nuts 53 on the studs 52 are tightened to press the casting tightly against the flat plate 50. This clamping of the casting against the plate 50 prevents warping of the casting as it is cooled.

From the above description, it should therefore be understood that this invention provides a unit having upstanding precisely positioned magnet core fingers integrally anchored to and embedded in a cast metal base or frame thereby avoiding heretofore required drilling, pressing and cementing operations to mount the cores on a pre-cast base or frame.

It will be apparent that many modifications and variations could be effected by one skilled in the art without departing from the spirit or scope of the novel concepts of the present invention, so that the scope of the invention should be determined by the appended claims only.

I claim as my invention:

1. A multiple magnet core unit for relays of teleprinters and the like which comprises a non-magnetic cast metal frame having an elongated platform, a row of upstanding magnetic metal core fingers transversely spaced along the length of the platform having integral depending portions cast in-situ in the frame directly surrounded by and intimate with the frame metal and said portions fixedly positioning said fingers to present free ends at precise locations relative to the frame.

2. The unit of claim 1 wherein the fingers are U-shaped with upstanding legs connected by a bight portion having a depending tab surrounded by the cast metal.

3. The unit of claim 1 including a pair of spaced parallel rows of core fingers in side-by-side relation on said platform.

4. The unit of claim 1 wherein said fingers are U-shaped steel plates with the metal grain extending lengthwise of the legs thereof.

5. The unit of claim 1 wherein the fingers are U-shaped steel stampings with a bight portion having a depending anchoring tab with a narrow shank and an enlarged end head on the shank.

6. The unit of claim 1 wherein the frame has upstanding flanges along the outer sides of the platform and the ends of the fingers are substantially flush with the tops of the flanges.

7. A die casting which comprises a base of non-magnetic metal having an elongated platform, a row of upstanding magnetic metal fingers projecting from and exposed beyond said platform in transversely spaced parallel relation, and said fingers having bottom portions cast in-situ and surrounded directly by and intimate with the cast non-magnetic metal frame to fixedly anchor the fingers at precise locations on the platform.

8. The die casting of claim 7 wherein the fingers are U-shaped steel stampings with bight portions having depending tabs embedded in the cast metal.

9. The die casting of claim 7 including a plurality of rows of fingers on said platform in side-by-side relation.

10. The die casting of claim 9 including a raised central ridge on the platform between adjacent rows of fingers.

11. The unit of claim 1 including spools of wire coils around each finger.

* * * * *